US010151479B2

(12) United States Patent
Noman et al.

(10) Patent No.: US 10,151,479 B2
(45) Date of Patent: Dec. 11, 2018

(54) BURNER ASSEMBLY

(71) Applicant: Lennox Industries Inc., Richardson, TX (US)

(72) Inventors: Shiblee Noman, Tulsa, OK (US); Ian Burmania, Rockwall, TX (US)

(73) Assignee: Lennox Industries Inc., Richardson, TX (US)

( * ) Notice: Subject to any disclaimer, the term of this patent is extended or adjusted under 35 U.S.C. 154(b) by 623 days.

(21) Appl. No.: 14/087,807

(22) Filed: Nov. 22, 2013

(65) Prior Publication Data

US 2015/0147703 A1 May 28, 2015

(51) Int. Cl.

*F23D 14/10* (2006.01)
*F23D 14/70* (2006.01)
*F23D 14/62* (2006.01)

(52) U.S. Cl.

CPC ..... *F23D 14/105* (2013.01); *F23D 14/62* (2013.01); *F23D 14/70* (2013.01)

(58) Field of Classification Search

CPC ..... F23D 2900/14063; F23D 14/70; F23D 14/62; F23D 14/105; F23D 14/04; F23K 5/007; F23K 2401/201; F23K 2401/20; F23K 2900/05004

USPC ..... 126/39 E, 307 R, 41 R, 214 D; 431/203, 431/249, 354, 191, 238, 285

See application file for complete search history.

(56) References Cited

U.S. PATENT DOCUMENTS

| | | | | | |
|---|---|---|---|---|---|
| 1,451,072 | A * | 4/1923 | Hoffstetter | F23D 14/04 | 239/553.3 |
| 2,541,710 | A * | 2/1951 | Miller | F23D 14/10 | 239/416.5 |
| 3,028,909 | A * | 4/1962 | Faure | F23D 14/105 | 239/560 |
| 4,773,384 | A * | 9/1988 | Koziol | A47J 37/0682 | 126/39 R |
| 6,092,518 | A * | 7/2000 | Dane | F23D 14/06 | 126/214 D |
| 2008/0264310 | A1* | 10/2008 | Jia | F23C 9/003 | 110/186 |
| 2009/0047611 | A1* | 2/2009 | Armanni | F23D 14/065 | 431/284 |
| 2010/0242944 | A1* | 9/2010 | Richardson | A47J 37/0713 | 126/25 B |

FOREIGN PATENT DOCUMENTS

| | | | | |
|---|---|---|---|---|
| DE | 1237962 B | * | 4/1967 | F23D 14/105 |
| GB | 1297005 | | 11/1972 | |

* cited by examiner

*Primary Examiner* — Avinash Savani
*Assistant Examiner* — Rabeeul Zuberi
(74) *Attorney, Agent, or Firm* — Winstead PC

(57) ABSTRACT

In various implementations, a burner assembly may include a body coupled to burner heads. The body may include one or more converging and/or diverging parts. For example, the body may include a diverging part proximate one or more of the burner heads of the burner assembly. The body may allow a predetermined fuel/air ratio to be provided to the burner head, in some implementations.

20 Claims, 8 Drawing Sheets

BURNER ASSEMBLY

TECHNICAL FIELD

The present disclosure relates to burner assemblies.

BACKGROUND

Burners generally include a single inlet coupled to a single burner head proximate an outlet. For example, a flammable fluid, as natural gas may be fed into the inlet of the burner and combusted proximate the burner head.

SUMMARY

In various implementations, a burner assembly may include a body with a fuel inlet. Fuel and/or primary air may flow through the fuel inlet and mix in the body of the burner assembly. The body may include one or more converging and/or diverging sections to mix the fuel and the primary air. The fluid stream of fuel and primary air may be provided to the burner head(s) of the burner assembly for combustion of the fuel in the fluid stream.

In various implementations, a burner assembly may include a body. The body may include a first end, a second end opposing the first end, a first section, a second section and a third section. The first section may be disposed proximate the second end and may include a first converging portion. The second section may be disposed proximate the second end and the first section. The second section may include a first diverging portion. The third section may be disposed proximate the second end, and may include a second converging portion. The second section may be disposed between the first section and the third section of the body. The body may include fuel inlet(s) coupled proximate the first end of the body. The body may include one or more burner heads coupled proximate the second end of the body.

Implementations may include one or more of the following features. The body may include at least one fuel inlet, which includes a third converging portion. A ratio of a volume of the second section to a volume of the first section may be approximately 5 to approximately 5.5. A ratio of a volume of the first section to a volume of the third section may be approximately 1.3 to approximately 1.5. In some implementations, a ratio of a volume of the second section to a volume of the third section may be approximately 7.2 to approximately 7.4. The arc radius of at least a portion of the first diverging part may be approximately 5 inches to approximately 6 inches. A volume of an arc portion of the first diverging part may be approximately 4 cubic inches to approximately 4.5 cubic inches. An angle of at least a portion of the first converging part comprises from approximately 10 degrees to approximately 12 degrees. The burner assembly may include a fuel outlet, which directly provides fuel to at least one of the fuel inlets.

In various implementations, a method of providing heat may include allowing at least a portion of a fuel stream to flow to at least one inlet of a burner assembly, and allowing a primary air stream to flow at least partially into at least one of the inlets of the burner assembly. At least a portion of the primary air stream and at least a portion of the fuel stream may be allowed to at least partially mix in a body of the burner to form a mixed stream. The mixed stream may be allowed to flow to burner head(s) of the burner assembly through a first section of the body, a second section of the body, and/or a third section of the body. The first section may include a first converging section and/or the second section comprises a first diverging section. The third section may include a second converging section. Combustion of at least a portion of fuel in the mixed stream proximate one or more of the burner heads of the burner may be allowed.

Implementations may include one or more of the following features. Allowing at least a portion of a fuel stream to flow to at least one inlet of a burner assembly may include allowing at least a portion of the fuel stream to flow directly to at least one inlet. At least a portion of the primary air stream and at least a portion of the fuel stream may be allowed to mix by allowing flow through a fourth section, a fifth section, an sixth section, a seventh section, an eighth section and/or a ninth section. The fourth section may include a fuel inlet and may include a third converging portion. The fifth section may include a straight portion. The sixth section may include a second diverging portion. The seventh section may include a third diverging portion. The eighth section may include a fourth converging portion. A ninth section may include a fourth diverging portion. In some implementations, allowing the flow through the first section may include reducing a velocity of the mixed stream in the first section and/or allowing the flow through the second section may include allowing the mixed stream to expand in the second section. Allowing the flow through the third section may include reducing the velocity of the mixed stream in the third section. Allowing the flow through the third section may include allowing at least a portion of the primary air stream and at least a portion of the fuel stream to mix by allowing flow through a fourth section, a fifth section, a sixth section, a seventh section, an eighth section, and/or a ninth section. The fourth section may include a fuel inlet and flow through the fourth section may reduce the velocity of the mixed stream in the fourth section. Flow through a sixth section may allow the mixed stream to expand in the sixth section. Flow through a seventh section may allow the mixed stream to expand in the seventh section. Flow through an eighth section may reduce the velocity of the mixed stream in the eighth section, and/or flow through a ninth section may allow the mixed stream to expand in the ninth section. In some implementations, at least a portion of a secondary air stream proximate one or more of the burner heads to at least partially mix with the mixed stream.

In various implementations, a burner assembly may include a first end of a body and a second end of a body opposing the first end. The burner assembly may include burner head(s) coupled proximate the second end of the body. The burner assembly may include at least two arms extending from the first end of the body. Each arm may include a first end and a second opposing end. A second end of an arm may be coupled to a second end of the body. The burner assembly may include at least two fuel inlets, and each fuel inlet may be coupled proximate the first end of an arm. The burner assembly may include at least two first sections of the body, at least two second sections of the body, and at least one third section of the body. Each first section may be disposed proximate the second end of an arm. Each second section may be disposed proximate a first section, and at least one of the second sections may include a first diverging part. Each second section may be disposed between at least one of the first sections and at least one of the third sections of the body.

Implementations may include one or more of the following features. The burner assembly may include a fuel outlet to deliver fuel to one or more of the fuel inlets. At least one of the first sections of the body may include a first converging part. At least one of the third sections of the body may include a second converging part. At least one of the fuel inlets may include a second converging part. At least one of the arms may include a fourth section and/or a fifth section. The fourth section may include an approximately straight part and/or the fifth section may include a second diverging part.

The details of one or more implementations are set forth in the accompanying drawings and the description below. Other features, objects, and advantages of the implementations will be apparent from the description and drawings.

BRIEF DESCRIPTION OF THE DRAWINGS

For a more complete understanding of this disclosure and its features, reference is now made to the following description, taken in conjunction with the accompanying drawings, in which.

Like reference symbols in the various drawings indicate like elements.

DETAILED DESCRIPTION

Figure 1A:
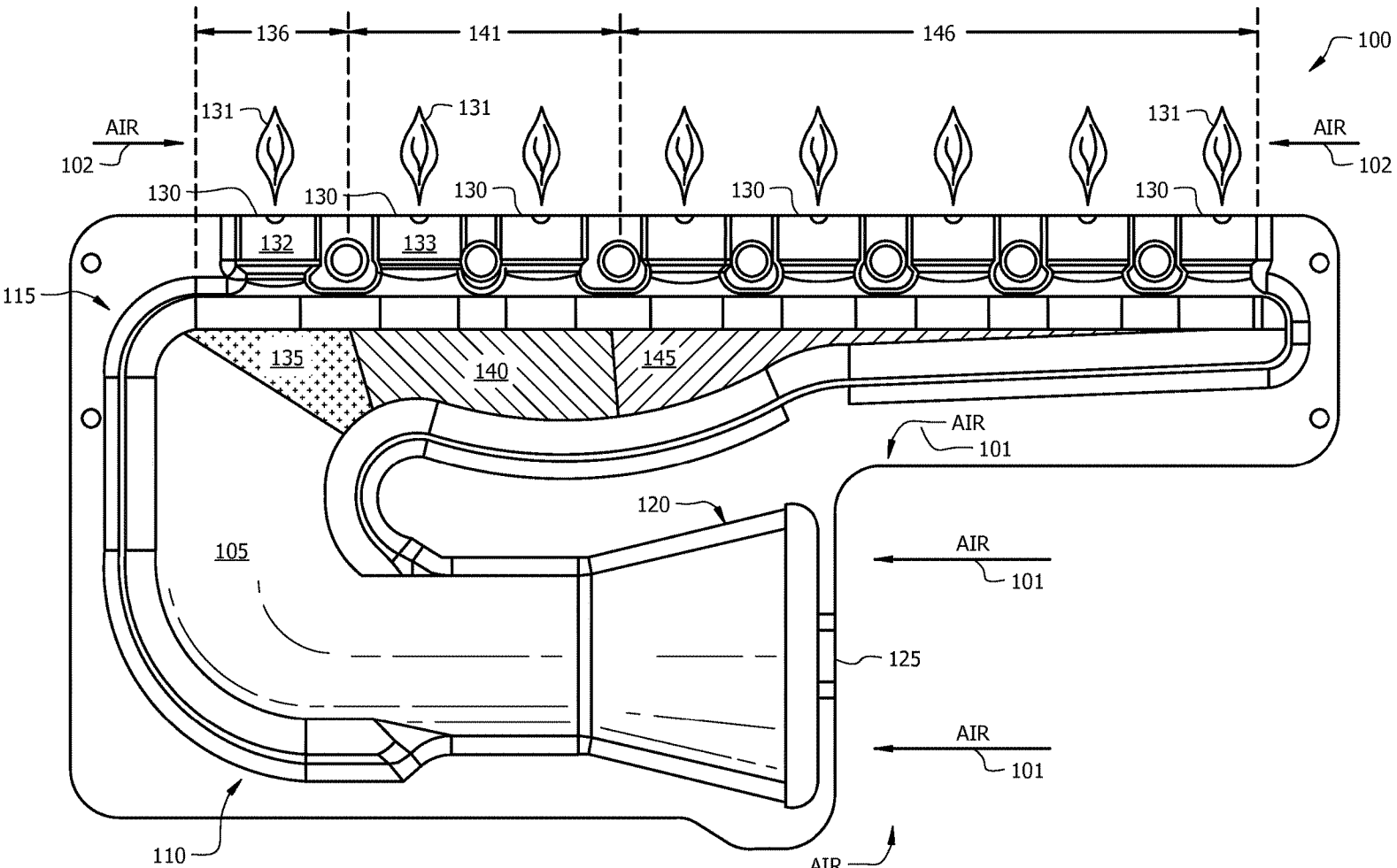
FIG. 1A illustrates an implementation of an example burner assembly.

Burners may allow combustion of fuel in the presence of air. Fuel may include flammable fluids, such as natural gas, heating oil, and/or propane. A burner may be utilized to provide heat, for example, in heat exchangers, such as furnaces; boilers; and/or other applications. For example, a burner may be disposed proximate a heat exchanger (e.g., a shell and tube heat exchanger) such that the flames from the combustion of the fuel in the burner are disposed proximate the openings of the heat exchanger. An inducer may draw the heated air, for example, generated by flames towards the heat exchanger.

In various implementations, a burner assembly may include one or more sections. The sections may include converging portions and/or diverging portions. The sections may include straight portions, in some implementations. A converging portion may include one or more sides that at least partially converge. For example, the converging portion may have a greater cross-sectional area proximate an inlet of the converging portion than a cross-sectional area proximate an outlet of the converging portion. A diverging portion may include one or more sides that at least partially diverge. For example, the diverging portion may have a greater cross-sectional area proximate an outlet of the diverging portion than a cross-sectional area proximate an inlet of the diverging portion. A straight portion may include two or more sides that are approximately parallel, in some implementations.

FIG. 1 illustrates an implementation of an example burner assembly 100. As illustrated, the burner assembly 100 may include a body 105. The body 105 may include a first end 110 and a second end 115. The first end 110 may be disposed opposingly to the second end 115.

The burner assembly 100 may include at least one fuel inlet 120. The fuel inlet 120 may be disposed proximate the first end 110. The fuel inlet 120 may include an opening 125 through which fuel (e.g., a fluid that includes a flammable fluid, such as natural gas) may be provided to the burner assembly 100. For example, a fuel outlet (not shown) may provide fuel via an outlet to one or more fuel inlets 120.

The burner assembly 100 may include two or more burner heads 130. In some implementations, the burner assembly may include a plurality of burner heads 130. The burner heads 130 of the burner assembly 100 may have similar and/or different configurations (e.g., cross-sectional shape, cross-sectional area, height, length, and/or width). The fuel may be allowed to flow through the burner assembly 100 to burner head(s) 130 and be allowed to combust proximate an outlet of the burner head. For example, a flame 131 from combustion of the fuel may be disposed at least partially outside the burner head 130 and proximate the burner head.

For example, burner head arrangements similar to the burner head arrangements described in U.S. patent application Ser. No. 14/079,826, entitled "MULTI-BURNER HEAD ASSEMBLY", filed on Nov. 14, 2013, may be utilized. For example, the burner assembly may include one or more burner heads with different burner heights. In some implementations, the burner head heights may be adjustable. One or more of the burner heads may have different configurations. The burner head configurations may be selected to provide a desired flame profile (e.g., flame size and/or flame temperature).

In various implementations, a fuel may be provided to a burner assembly 100 by a fuel outlet. The fuel outlet may release a stream of fuel proximate the fuel inlet 120. The fuel may then enter the fuel inlet 120. A primary air stream 101 may be proximate the fuel inlet 120. At least a portion of the primary air stream 101 may enter the fuel inlet 120 with the fuel from the fuel outlet and mix with the fuel in the body 105 of the burner assembly 100. The fluid (e.g., fuel and air from the primary air stream) may continue to mix as the stream flows through the body. The fluid (e.g., fuel and air mixed stream) may then be provided to the burner heads for combustions. A secondary air stream 102 may be disposed proximate the burner heads. The secondary air stream 102 may mix with the fluid (e.g., fuel and air mixed stream) at least partially in the body 105 of the burner assembly and/or proximate the flame 131 generated from the combustion of the fuel. The second air stream 102 may aid the combustion of the fuel in the fluid provided to the burner head(s).

In various implementations, the body 105 of the burner assembly 100 may include a plurality of sections. The configuration of the sections (e.g., shape and/or size) of the body 105 may control the amount of fluid (e.g., fuel and/or air) delivered to a burner head and/or the flame profile produced by the burner assembly 100. For example, the body 105 may include a first section 135, a second section 140, and a third section 145 disposed proximate the second end 115 of the body and/or the burner head(s) 130. The second section 140 may be disposed between the first section 135 and the third section 145.

As illustrated in FIG. 1, the first section 135 may be disposed proximate a first set 136 of burner heads. For example, the first section 135 may be disposed proximate a burner head, first burner head 132, which is closest in the fuel path to the fuel inlet. The second section 140 may be disposed proximate a second set 141 of burner heads. For example, the second section 140 may be disposed proximate the second burner head 133 and one or more other burner heads (e.g., third burner head, fourth burner head, fifth burner head, and/or sixth burner head). The third section 145 may be disposed proximate a third set 146 of burner heads. For example, the third section 145 may be disposed proximate the burner head, last burner head 134, which is farthest in the fluid path (e.g., the path in which the fuel and air travel in the burner assembly) from the fuel inlet 12, and one or more other burner heads.

The sections of the body 105 may include converging portions, diverging portions, and/or straight portions. For example, the first section 135 may include a converging section. The second section 140 may include a diverging section. The third section 145 may include a converging section, in some implementations. The first section 135 may be coupled to the second section 140 and the second section may be coupled to the third section 145, in some implementations.

The configuration of a section (e.g., converging, diverging, and/or straight portions) may be selected based on the flame profile to be generated by the burner assembly 100. For example, to produce an approximately uniform flame profile via the burner assembly, the configuration may be selected such that an amount of fluid (e.g., fuel/air mixture) and/or such that a predetermined ratio of fuel/air may be provided to the burner head. In some implementations, to produce a predetermined flame profile, a configuration of the burner assembly (e.g., burner characteristics, such as burner height and/or width; body characteristics, such as number and/or position of converging and diverging sections; and/or inclusion of one or more fuel inlets) may be selected.

For example, if a burner assembly includes sections that include approximately similar configurations (e.g., volume, cross-sectional area, and/or arc ratio) the properties of the fluid provided to each of the burner heads may vary. For example, proximate the first set of burner heads, fuel rich fluid (e.g., fuel/air ratio greater than a predetermined first ratio) may be provided by the burner assembly. The second set of burners in a burner with similar sections may allow incomplete combustion due to less mixing with the secondary air stream. Thus, by altering the configuration of the part of the burner assembly proximate the burner heads, the flame profile of the burner assembly may be controlled.

In some implementations, the fluid (e.g., fuel and/or primary air) may be allowed to pass through converging and/or diverging sections to control and/or manage the flame profile (e.g., size, and/or temperature of flames produced by the combustion of fuel proximate burner head(s)) generated by the burner assembly. The amount of fluid (e.g., fuel and/or primary air) allowed to flow to burner heads in a section may be greater if the section includes a diverging section when compared to a converging section. In some implementations, a diverging section may decrease the velocity and/or flow rate of fluid through a section. The diverging section may thus increase the amount of secondary air allowed to mix with the fluid (e.g., fuel/air mixture) provided to a burner head, in some implementations.

In some implementations, the fluid (e.g., fuel and/or air) allowed to flow to burner heads may be controlled at least partially based on by the volume of the section(s). FIG. 1 B illustrates an implementation of an example burner assembly 150. As illustrated, the volume 155 of the first section 135 may be approximately 2.5 cubic inches to approximately 3.5 cubic inches. The volume 160 of the second section 140 may be approximately 14.5 cubic inches to approximately 15.5 cubic inches. The volume 165 of the third section 145 may be approximately 1.5 to approximately 2.5 inches. In some implementations, the ratio of the volume 160 of the second section 140 to the volume 155 of the first section 135 may be approximately 5 to approximately 5.5. The ratio of the volume 155 of the first section 135 to the volume 165 of the third section 145 may be approximately 1.3 to approximately 1.5. The ratio of the volume 160 of the second section 140 to the volume 165 of the third section 145 may be approximately 7.2 to approximately 7.4.

FIG. 1 C illustrates an implementation of an example burner assembly 175. As illustrated, the body 105 proximate the second end 115 may include curvatures. In some implementations, the arc radius 180 of at least a portion of the second section 140 and/or a portion of the third section 145 may be approximately 5 inches to approximately 6 inches. For example, the arc radius 180 of the second section may be approximately 5.5 inches. In some implementations, the volume of the arc of the second section, arc volume 185, may be approximately 4 to approximately 4.5 cubic inches.

In some implementations, the arc radius 180 of at least a portion of the second section may be approximately 3 inches. The arc volume 185 of the section may be approximately 1 to approximately 1.5 cubic inches. For example, the arc volume 185 may be approximately 1.2 cubic inches.

In some implementations, an angle of at least a portion of the first converging part comprises from approximately 7 degrees to approximately 15 degrees (e.g., approximately 10 degrees to approximately 12 degrees and/or approximately 11 degrees). An angle of at least a portion of the second converging part comprises from approximately 45 degrees to approximately 55 degrees (e.g., approximately 48 degrees to approximately 51 degrees and/or approximately 50 degrees).

Figure 1B:
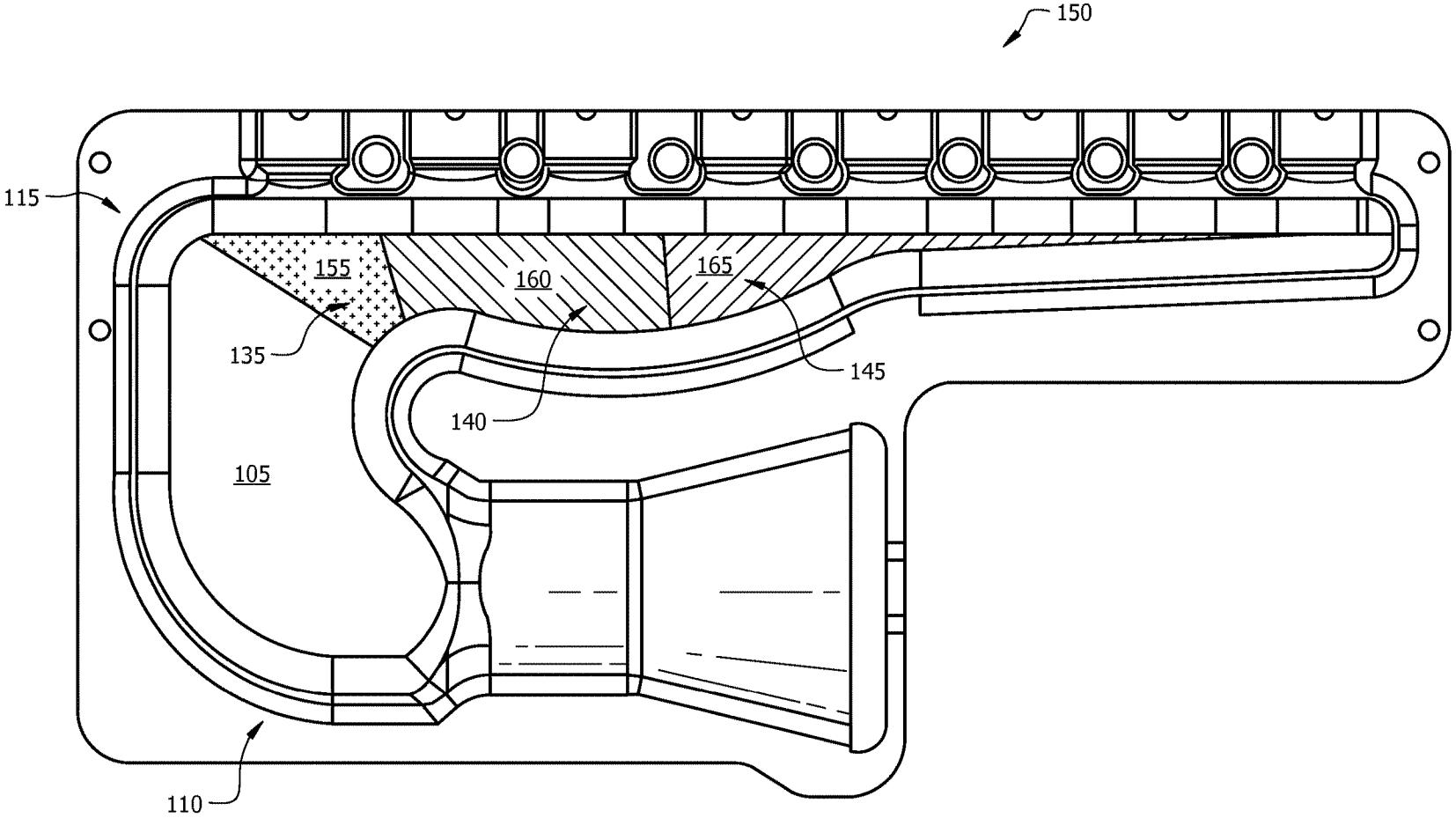
FIG. 1B illustrates an implementation of an example burner assembly.
Figure 1C:
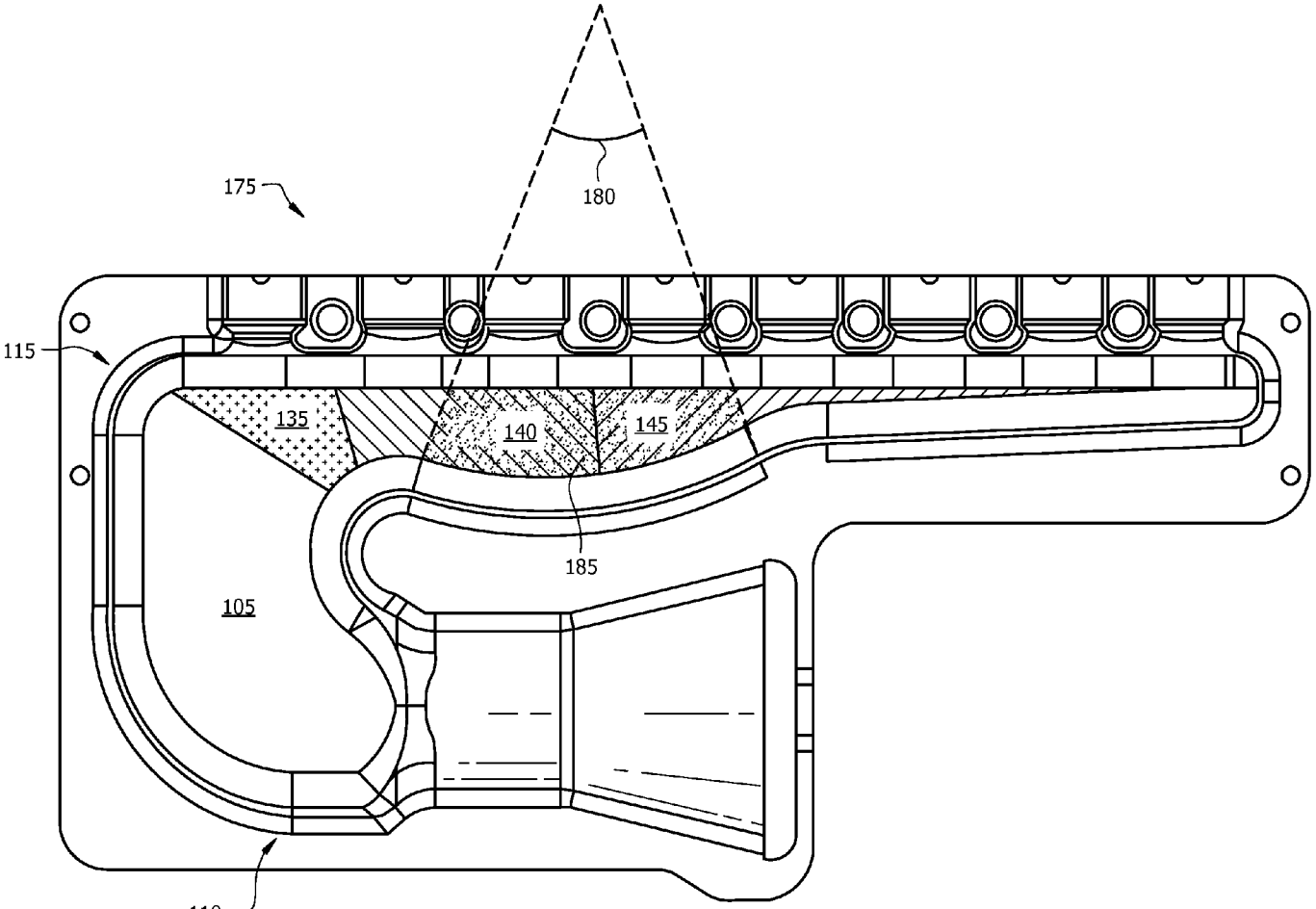
FIG. 1C illustrates an implementation of an example burner assembly.

Although the burner assembly, as illustrated in FIGS. 1A-1C, include a specific implementation of a burner assembly, other burner assembly configurations may be utilized as appropriate. For example, more than one fuel inlet may be provided. In some implementations, one or more other converging and/or diverging sections may be included in the body. The burner assembly may be disposed proximate a fuel inlet during use to provide the fuel for combustion. In some implementations, each outlet of a fuel inlet may provide fuel to one of the fuel inlets of the burner assembly.

Figure 2A:
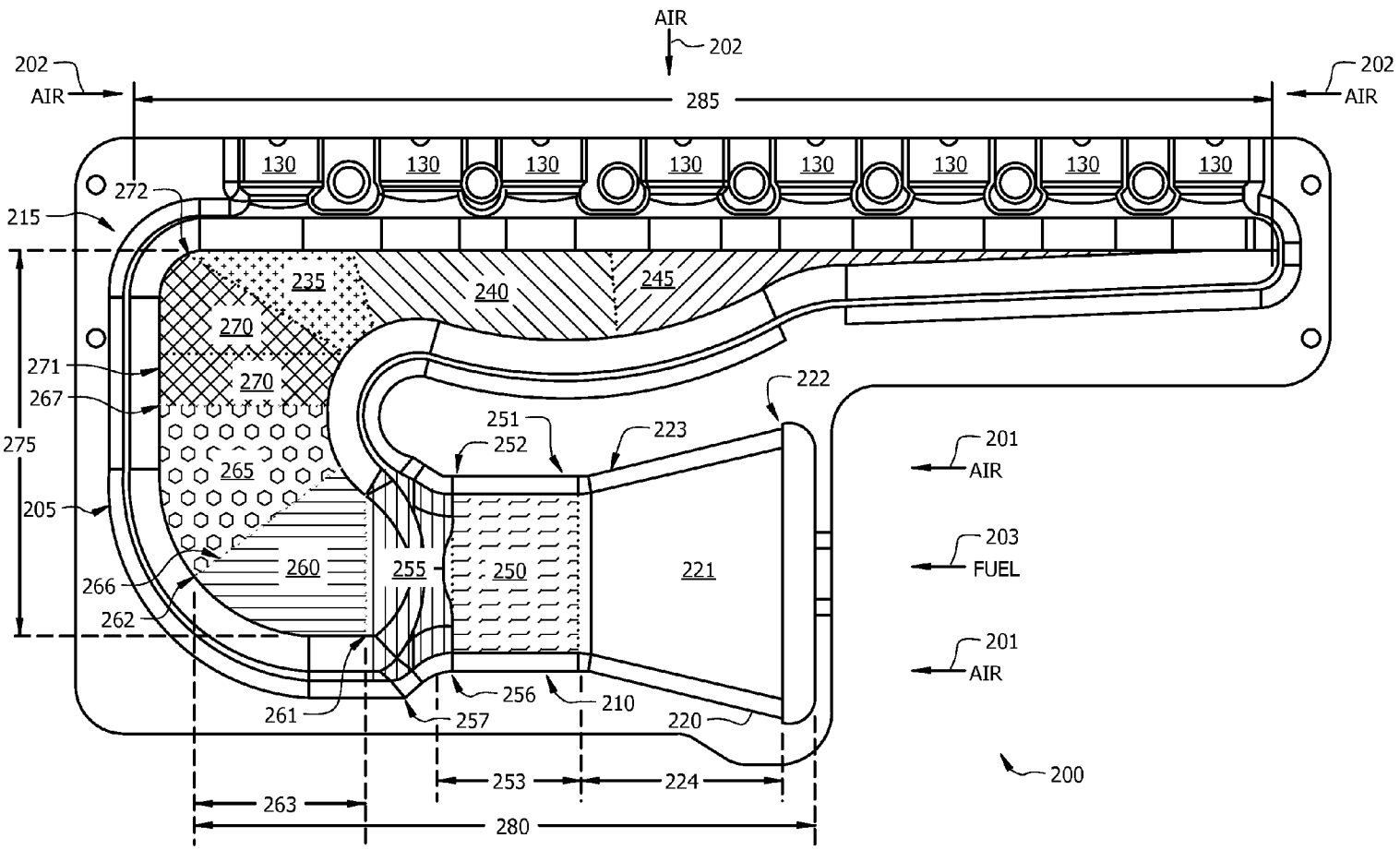
FIG. 2A illustrates a cutaway view of an implementation of an example burner assembly.
Figure 2B:
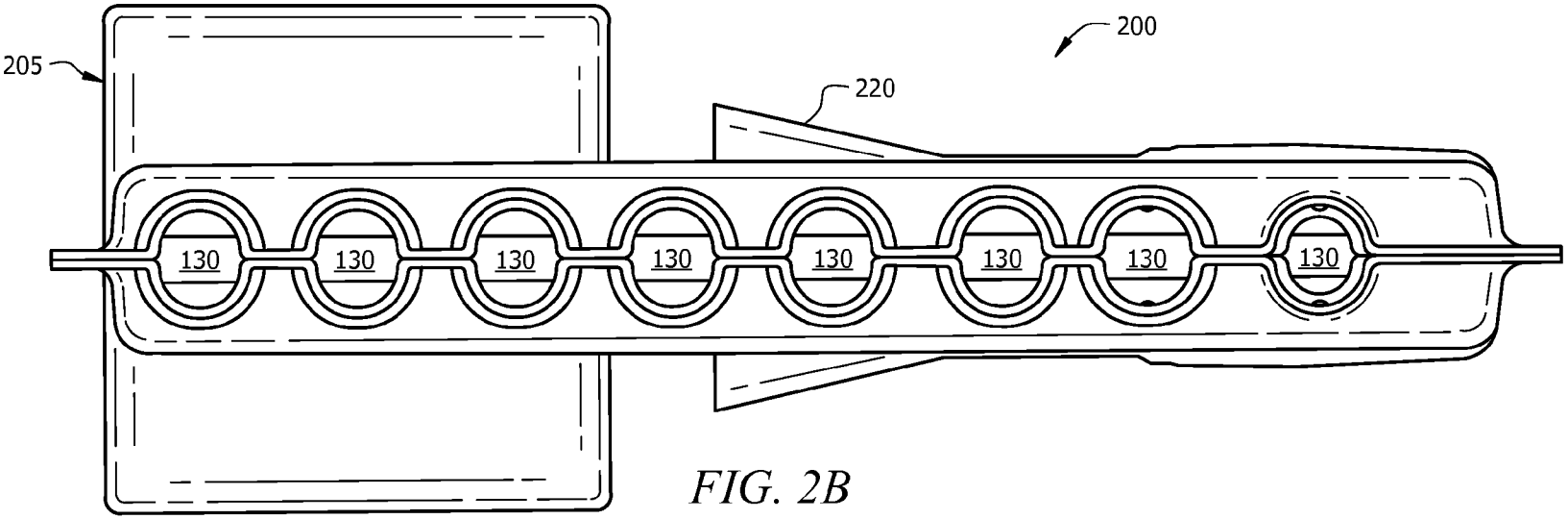
FIG. 2B illustrates a top view of an implementation of the example burner of FIG. 2A.
Figure 2C:
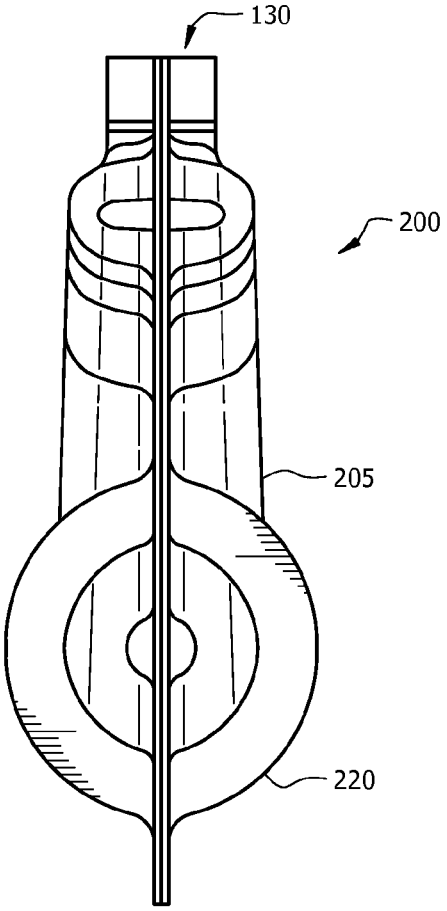
FIG. 2C illustrates a side view of an implementation of the example burner of FIG. 2A.
Figure 2D:
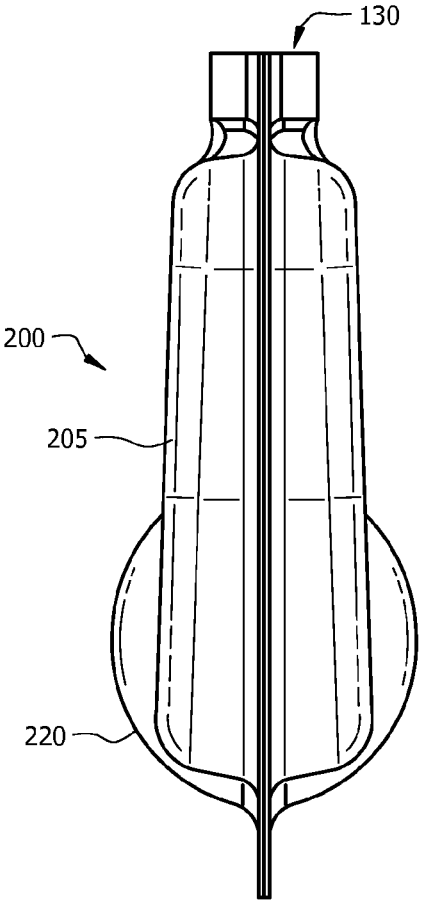
FIG. 2D illustrates a side view of an implementation of the example burner of FIG. 2A.

The body of the burner assembly may include one or more other sections. FIG. 2A illustrates cutaway view of an implementation of an example burner assembly 200. FIG. 2B illustrates a top view of an implementation of the example burner of FIG. 2A. FIG. 2C illustrates a side view of an implementation of the example burner of FIG. 2A. FIG. 2D illustrates a side view of an implementation of the example burner of FIG. 2A.

As illustrated, the body 205 includes a first end 210 and a second end 215. The body includes a fuel inlet 120 proximate the first end 210 of the body 205. The body 205 includes a plurality of burner heads 130 proximate the second end 215 of the body. Fuel 203 provided to the fuel inlet 120 may mix with air from a primary air stream 201 in the body 205 of the burner assembly and be provided to the burner head(s) 130. The fuel may be combusted proximate the burner head(s) 130.

The body may include a plurality of sections. The sections may include converging, diverging, and/or straight portions. The converging and/or diverging portions may allow the fluid (e.g., fuel and portions of the primary air stream 201) in the body 205 to mix. As illustrated the body 205 may include a first section 235, which includes a converging portion, proximate the second end. The body 205 may include a second section 240, which includes a diverging portion, and/or a third section 245, which includes a converging portion. The second section 240 may be proximate the second end 215 of the body 205 and may reside between the first section 235 and the third section 245. The third section may be proximate the second end 215.

The body 205 may include other sections proximate the first end 210 and/or between the first end 210 and the second end 215. The body 205 may include a fourth section 221. The fourth section 221 may include a converging portion. The fourth section 221 may include and/or be proximate to the fuel inlet 220 of the burner assembly 200. In some implementations, the fourth section 221 may have a negative pressure (e.g., caused by an inducer of a heat exchanger drawing the flame(s) of combustion proximate burner head(s) towards the heat exchanger) in at least a part of the fourth section to draw fuel 203 from a fuel outlet and/or at least a portion of the primary air stream 201 into the fuel inlet 120. The fourth section 221 may have a width and height of approximately 2.5 inches to approximately 2.6 inches proximate a first end 222 of the fourth section and a width and/or height of approximately 1.6 inches to approximately 1.7 inches proximate a second end 223 of the fourth section. The length 224 of the fourth section 221 may be approximately 2.2 to approximately 2.3 inches.

The body 205 of the burner assembly 200 may include a fifth section 250. The fifth section 250 may be coupled to the fourth section 221*f*. The fifth section 250 may include a straight portion. For example, the length and width proximate a first end 251 of the fifth section 250 may be approximately the same as the length and/or width proximate a second end 252 of the fifth section. The fifth section 250 may include a width and/or a height of approximately 1.6 inches to approximately 1.7 inches. Two or more sides of the fifth section 250 may be approximately parallel across a length 253 of the fifth section. The length 253 of the fifth section may be approximately 1.2 inches to approximately 1.3 inches.

The body may include a sixth section 255. The sixth section 255 may be coupled to the fifth section 250 at a first end 256 and to a seventh section 260 proximate a second end 257 of the sixth section. The sixth section 255 may include a diverging portion. The diverging portion may allow rapid expansion of the fluid (e.g., fuel/air mixture). The a width and/or height of the sixth section 255 may be approximately 1.6 inches to approximately 1.7 inches at a first end 256 and/or approximately greater than approximately 1.6 inches at a second end 257.

The body 205 may include a seventh section 260. The seventh section 260 may be coupled at a first end 261 to a sixth section 255 and/or coupled at a second end 22 to the eighth section 265. The seventh section 260 may include a diverging portion. The diverging portion may increase the mixing of fuel and air within the seventh section 260. A length 263 of the seventh section 260 may be approximately 2.5 inches to approximately 3.5 inches.

The body 205 may include an eighth section 265. The eight section 265 may be coupled to the seventh section 260 proximate a first end 266 and coupled to the ninth section 270 proximate a second end 267 of the eighth section. The eighth section 265 may include a converging portion.

The body 205 may include a ninth section 270. The ninth section 270 may be coupled proximate a first end 271 to the eighth section 265 and coupled proximate a second end 272 to the first section 235. The ninth section 270 may include a diverging portion.

In various implementations, the expansion and contraction of the fluid (e.g., fuel and/or air) in the body of the burner assembly may increase the homogeneity of the fluid mixture in the body (e.g., when compared with a straight body). For example, as illustrated, the body of the burner assembly includes a curvature between the first end and the second end. As the body curves, the fluid in the body may tend to stay towards the outer edge of the curve. By expanding and contracting the fluid through the diverging, converging, and/or straight portions of the body, fluid mixture may be increased (e.g., when compared to burner assemblies without converging and/or diverging portions).

In some implementations, the length 275 of a first part of the body 205 including the seventh section 260, the eighth section 265, and/or the ninth section 270 may be less than approximately 5 inches.

In some implementations, the length 280 of a second part of the body 205 including the fourth section 221, the fifth section 250, the sixth section 255, and/or the seventh section 260 may be less than approximately 4 inches.

In some implementations, the length 285 of a third part of the body 205 including the first section 235, the second section 240, and the third section 245 may be approximately 12 inches to approximately 14 inches. For example, the length 285 of the third part of the body 205 may be approximately 13 inches. The third part may include the burner heads.

Although the burner assembly as illustrated in FIG. 2A-2D include a plurality of sections, other burner assembly configurations may be utilized as appropriate. For example, the burner assembly may not include a fifth section that includes a straight portion. The fourth section may include a straight portion and/or not include a converging portion. The burner assembly may not include a sixth portion. In some implementations, the sixth section and the seventh section may be combined.

In various implementations, the length of the section(s) and/or the number of sections may affect the mixing of the fluid (e.g., fuel and at least a portion of the primary air stream). For example, inclusion of a one or more sections similar to the first section, second section, and/or third section of the burner assembly of FIG. 1A may allow mixing and/or more homogenous mixing of the fluid (e.g., fuel and primary air stream) when compared with a burner assembly without one or more converging and/or diverging sections.

Figure 3:
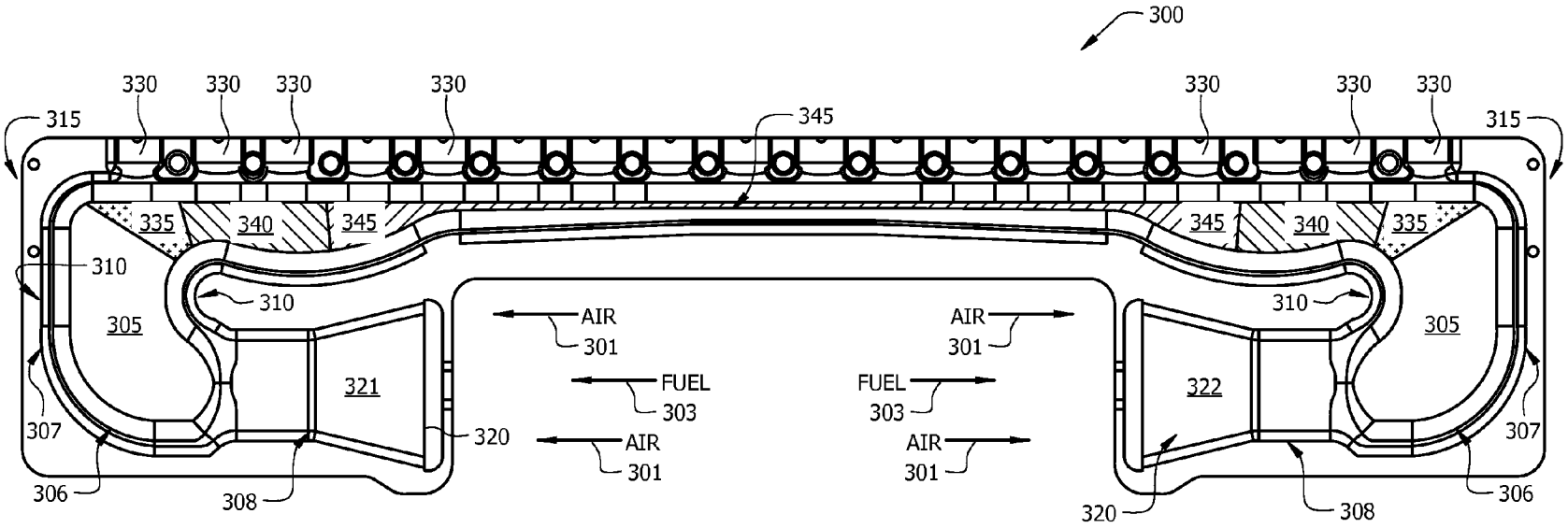
FIG. 3 illustrates an implementation of an example burner assembly.

In some implementations, the burner assembly may include more than one fuel inlet. The fuel inlets of the burner assembly may include at least one more burner head than fuel inlet, in some implementations. FIG. 3 illustrates an implementation of an example burner assembly 300 with more than one fuel inlet.

As illustrated, the burner assembly may include a body 305. The body 305 may include a first end 310 and a second opposing end 315. The burner assembly 300 includes two fuel inlets 320 a first fuel inlet 321 and a second fuel inlet 322. The burner heads 330 of the burner assembly 300 may be disposed proximate the second end 315 of the body 305. The fuel inlets 320 may receive fuel 303 and at least a portion of a primary air stream 301 and provide the fluid (e.g., fuel and air) to a plurality of burner heads 330 of the burner assembly 300 for combustion.

The body 305 may include at least two arms 306. Arm(s) 306 may extend from at least a part of the body. For example, the arm 306 may include a first end 307 and a second opposing end 308. The first end 307 of the arm 306 may be coupled proximate a first end 310 of the body 305. A second end 308 of the arm 306 may be coupled to a fuel inlet 320. In some implementations, each arm 306 may be coupled to a fuel inlet 320. The arms 306 may be disposed such that the fuel inlets 320 coupled to the arms are disposed opposingly, as illustrated in FIG. 3.

The arms 306 may include a cross-sectional shape and/or cross-sectional area that are uniform or different across a length of the arm. For example, each arm 306 may be a circular conduit extending from a first side 310 of the body 305. In some implementations, an arm 306 may include one or more converging sections and/or one or more diverging sections. For example, an arm may include a fourth section, a fifth section, a sixth section, a seventh section, and eight section, and/or a ninth section similar and/or different to the sections in FIGS. 1A-1C and/or 2A-2D.

The body may include one or more first sections 335, one or more second sections 340 and one or more third sections 345 disposed proximate the burner heads 330 of the burner assembly. As illustrated, the second end 315 of the body 305 may include two first sections 335, two second sections 340, and a third section 345. The first sections 335 may be disposed proximate a second end 307 of an arm 306. The first sections 335 may include more than one first set of burner heads. The first set of burner heads may include the burner head that is closest to a proximate arm of the burner assembly. For example, a first burner head of one of the first set of burners may be disposed proximate a second end of the first arm and/or a tenth burner head of an other first set of burners may be disposed proximate a second end of the second arm. In some implementations, the first section may include a converging portion. The converging section may reduce the amount of fuel and/or fluid delivered to the first set of burners (e.g., when compared to a first section without a converging portion). Since the fluid flowing through the body proximate the first set of burners is rich in fuel (e.g., since the fuel has not been combusted upstream of the first set of burners), reducing the amount (e.g., mass, volume, volumetric flow rate and/or mass flow rate) of fuel (e.g., by reducing the amount of fluid) delivered to the first set of burner heads via the converging section may allow more fuel (e.g., by providing more fluid) to be provided to the second and/or third set of burner heads.

The second sections may be disposed proximate the second end of the body and proximate the first section of the body. The second sections may include one or more second sets of burner heads. The second section may include a diverging portion. The diverging portion may allow a greater amount of fuel and/or a greater amount of fluid to be delivered to the second set(s) of burners (e.g., when compared with a second section without a diverging portion). Allowing the fluid (e.g., fuel/air mixture) to expand in the diverging portion may further mix the fuel and the air flowing through the burner. Thus, the homogeneity of the fuel/air mixture may be increased (e.g., when compared to a second section without a diverging section), in some implementations.

The third section(s) may be disposed between the second sections of the body. The third sections may include one or more third sets of burner heads. As illustrated, the burner assembly may include one third section disposed between the two second sections of the body. The third section may include a converging section. The converging portion of the third section may allow more fuel to be delivered to the second set of burner heads (e.g., by restricting the flow to the third section of the body) when compared to a third section without a converging section.

Although a specific implementation of a burner assembly with a double fuel inlet has been illustrated in FIG. 3, other implementations may be utilized as appropriate. In some implementations, other sections with converging, diverging, and/or straight portions may be included. For example, the burner assembly may include one or more arms that include a fourth section, a fifth section, a sixth section, a seventh section, an eighth section, and/or a ninth section. The fourth section may include a converging portion. The fifth section may include a straight portion. The sixth section may include a diverging portion. The seventh section may include a diverging portion. The eighth section may include a converging portion. The ninth section may include a diverging portion.

In some implementations, more than one fuel outlet may provide fuel to the burner assembly. The burner assembly may be utilized with a heat exchanger. An inducer may draw the flame from the combustion of fuel proximate the burner head towards the heat exchanger (e.g., towards openings in a heat exchanger, such as a shell and tube heat exchanger).

In some implementations, the burner assembly may be stamped in two or more portions and coupled (e.g., welded, adhered, and/or fastened) together. The burner assembly may include a unibody construction body.

Figure 4:
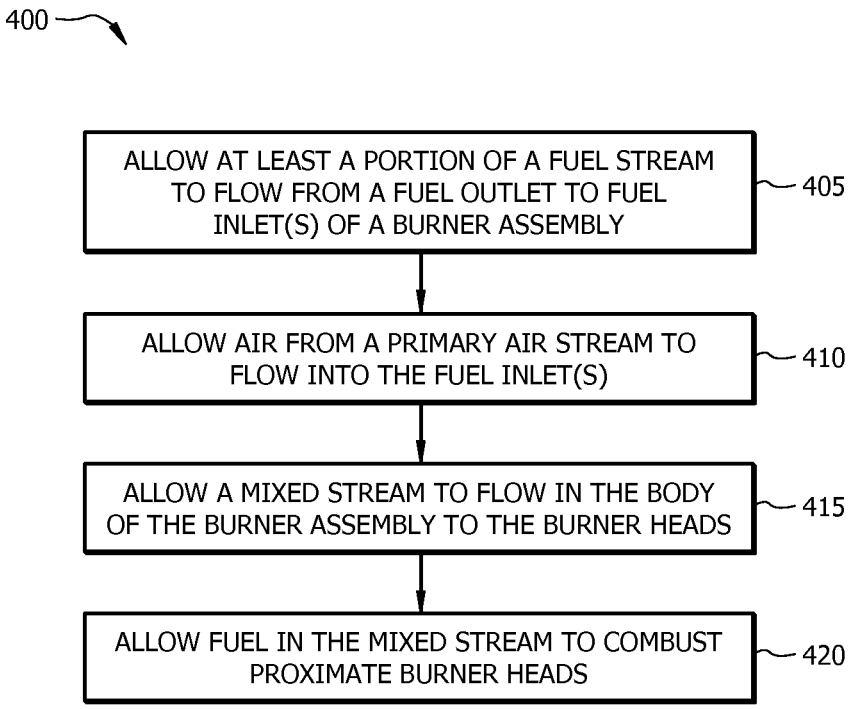
FIG. 4 illustrates an implementation of an example process for allowing combustion of fuel using an example burner assembly.

In various implementations, fuel may be provided to the burner assembly to generate heat via the combustion of the fuel. FIG. 4 illustrates an implementation of an example process 400 for allowing combustion using a burner assembly. At least a portion of a fuel stream may be allowed to flow from a fuel outlet to at least one fuel inlet of the burner assembly (operation 405). The burner assembly may include at least one more burner head than the number of included fuel inlets. For example, the burner assembly may include one fuel inlet and eight burner heads. A burner assembly may include two fuel inlets and eight burner heads, in some implementations. The fuel outlet may direct fuel towards the fuel inlet of the burner assembly.

Air from a primary air stream may be allowed to flow into the fuel inlet(s) (operation 410). A primary air stream may be proximate the fuel inlet of the burner assembly. As fuel is drawn into the fuel inlet (e.g., via the velocity of the fuel from the fuel outlet and/or via a negative pressure in the fuel inlet from the flames of combustion proximate the burner heads being drawn towards, for example, a heat exchanger by an inducer), at least a portion of the primary air stream may be drawn into the fuel inlet of the burner assembly.

A mixed stream of fuel and air may be allowed to flow in the body of the burner assembly to the burner heads (operation 415). The mixed stream of fluid (e.g., fuel and air) may mix as the fluid flows through at least a portion of the body. Flowing through the body of the burner assembly may include allowing the mixed stream to flow through a first section of the body of the burner assembly. The mixed stream of fluid may be compressed and/or the velocity of the mixed stream of fluid may be increased via the converging portion of the first section.

The fuel in the mixed stream may then be allowed to combust proximate burner head(s) of the burner assembly (operation 420). For example, the mixed stream of fluid may be allowed to flow from the first section of the body to the first set of burner heads and the second section of the body.

At least a first portion of the mixed stream (e.g., at least a portion of the fuel in the fluid) may be allowed to combust proximate the first set of burner heads. The first set of burner heads may include the burner head in the fluid flow path that is the closest to the fuel inlet.

At least a second portion of the mixed stream of fluid may be allowed to flow to the second section of the body. The second portion of the mixed stream of fluid may be allowed to expand and/or a velocity of the second portion of the mixed stream may be decreased via a diverging portion of the second section. At least a third portion of the second portion of the mixed stream of fluid in the second section of the body may be provided to the second set of burner heads and at least a fourth portion of the second portion of mixed stream may be provided to the third section. The third portion of the mixed stream of fluid provided to the second set of burner heads may be allowed to combust proximate the burner heads of the second set of burner heads.

The fourth portion of the mixed stream of fluid may be allowed to flow from the second section of the body to the third section of the body. The fourth portion may be allowed to compress and/or the velocity of the fluid may be increased via a converging portion of the third section. At least a portion of the fourth portion may be provided to the third set of burner heads. At least a portion of the fuel in the fourth portion may be allowed to combust proximate one or more of the burner heads of the third set of burners.

Process 400 may be implemented by various systems, such as systems 100, 150, 175, and 200. In addition, various operations may be added, deleted, and/or modified. For example, the burner assembly may include more than one fuel inlet and at least one more burner head than fuel inlet. In some implementations, a secondary air stream may be disposed proximate the burner heads of the burner assembly. At least a portion of the secondary air stream may be allowed to mix with the portion of the fluid (e.g., mixed stream of fuel and/or primary air) provided to a burner head for combustion. For example, the secondary air stream and/or portions thereof may at least partially enter the body of the burner assembly to mix with the mixed stream or portions thereof. In some implementations, the secondary air stream and/or portions thereof may mix with the fluid (e.g., mixed stream) flowing from a burner head and/or provide air to the flame of combustion proximate the burner head. Mixing the secondary air stream with the portion of the mixed stream of fluid provided for combustion proximate a burner head may allow more complete combustion of the fuel in the mixed stream.

In some implementations, the mixed stream of fluid may flow through one or more other sections of the body. The sections may further mix the fluid (e.g., mixed stream), in some implementations. For example, the mixed stream may be allowed to flow from the fuel inlet (e.g., fourth section that includes a converging portion of the fuel inlet) to a fifth section of the burner assembly. The mixed stream in the fifth section (e.g., including a straight portion) may be provided to a sixth section of the body. The mixed stream may be expanded and/or the velocity of the mixed stream may be decreased via a diverging portion of the sixth section.

The mixed stream of fluid may be allowed to flow from the sixth section to the seventh section. The seventh section may include a diverging portion. In some implementations, the seventh section may include a diverging portion and a straight portion. The mixed stream may be expanded and/or a velocity of the mixed stream may be decreased via the diverging portion of the seventh section.

The mixed stream from the seventh section may be provided to an eighth section. The mixed stream may be compressed and/or a velocity of the mixed stream may be increased via a converging portion of the eight section.

The mixed stream from the eighth section may be provided to a ninth section. The mixed stream may be expanded and/or a velocity of the mixed stream may be decreased via the diverging portion of the ninth section. The mixed stream may be provided from the ninth section to the first section(s) of the burner assembly.

By allowing the mixed stream to flow through the converging and/or diverging sections of the body the fuel and the air in the mixed stream may become more mixed (e.g., when compared with a straight tubing).

In some implementations, a manifold may not be included in the burner assembly. The fuel may be provided by the gas outlet directly to the burner assembly. For example, the fuel may be provided by the gas outlet to the fuel inlet of the burner assembly and directly provided to the burner heads (e.g., rather than splitting the fuel provided by the gas outlet into individual streams, each of which is provided to an individual burner head).

In some implementations, a flame arrestor may be included to inhibit flashback. The burner assembly may inhibit flashback through the configuration of the burner assembly (e.g., burner size such as height and cross-sectional area, body dimensions, etc.) and a flame arrestor may not be included.

Various described patents and patent applications have been incorporated by reference. The described patents and patent applications are incorporated by reference to the extent that no conflict exists between the various described systems and/or processes and the described patents and patent applications. Any portion(s) of such described patents and patent applications that are in conflict with the various described systems and/or processes are not incorporated by reference.

It is to be understood the implementations are not limited to particular systems or processes described which may, of course, vary. It is also to be understood that the terminology used herein is for the purpose of describing particular implementations only, and is not intended to be limiting. As used in this specification, the singular forms "a", "an" and "the" include plural referents unless the content clearly indicates otherwise. Thus, for example, reference to "a burner head" includes a combination of two or more receivers; and, reference to "a burner head" includes different types and/or combinations of burner heads. As another example, "coupling" includes direct and/or indirect coupling of members.

Although the present disclosure has been described in detail, it should be understood that various changes, substitutions and alterations may be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A burner assembly comprising:

a body comprising:

a first end comprising one or more fuel inlets;

a second end opposing the first end and comprising a row of burner heads;

a generally u-shaped curvature portion between the first and second end;

a first section bordered on one side by the row of burner heads and having an opposite internal convex-shaped side, the first section disposed proximate the second end and the generally u-shaped curvature portion, wherein the first section converges and is downstream from the generally u-shaped curvature portion;

a second section bordered on one side by the row of burner heads and having an opposite internal convex and concave-shaped side, the second section disposed proximate the second end and disposed proximate the first section, wherein the second section diverges and is downstream from the first section;

a third section bordered on one side by the row of burner heads and having an opposite internal concave-shaped side portion disposed proximate the second end, wherein the third section converges and is downstream from the second section, wherein the third section converges until an end of the row of burner heads; and wherein the second section is disposed between the first section and the third section of the body.

2. The burner assembly of claim 1, wherein the body further comprises at least one fuel inlet, and wherein the fuel inlet further comprises a third converging portion.

3. The burner assembly of claim 1, wherein a ratio of a volume of the second section to a volume of the first section comprises approximately 5 to approximately 5.5.

4. The burner assembly of claim 1, wherein a ratio of a volume of the first section to a volume of the third section comprises approximately 1.3 to approximately 1.5.

5. The burner assembly of claim 1, wherein a ratio of a volume of the second section to a volume of the third section comprises approximately 7.2 to approximately 7.4.

6. The burner assembly of claim 1, wherein an arc radius of at least a portion of the first diverging part comprises approximately 5 inches to approximately 6 inches.

7. The burner assembly of claim 1, wherein a volume of an arc portion of the first diverging part comprises approximately 4 cubic inches to approximately 4.5 cubic inches.

8. The burner assembly of claim 1, wherein an angle of at least a portion of the first converging part comprises from approximately 10 degrees to approximately 12 degrees.

9. The burner assembly of claim 1, further comprising a fuel outlet, wherein the fuel outlet directly provides fuel to at least one of the fuel inlets.

10. A method of providing heat, wherein the method comprises:

allowing at least a portion of a fuel stream to flow to at least one inlet of a burner assembly, wherein the burner assembly comprises a first end and a second end and a generally u-shaped curvature portion between the first and second ends, the first end comprising one or more inlets and the second end comprising a row of burner heads;

allowing a primary air stream to flow at least partially into at least one of the inlets of the burner assembly;

allowing at least a portion of the primary air stream and at least a portion of the fuel stream to at least partially mix in a body of the burner to form a mixed stream;

allowing the mixed stream to flow to one or more burner heads of the burner assembly through at least one of:

a first section of the body bordered on one side by the row of burner heads and having an opposite internal convex-shaped side, wherein the first section converges and is downstream of the generally u-shaped curvature portion;

a second section of the body bordered on one side by the row of burner heads and having an opposite internal convex and concave-shaped side, wherein the second section diverges and is downstream of the first section;

a third section of the body bordered on one side by the row of burner heads and having an opposite internal concave-shaped side portion, wherein the third section converges and is downstream of the second section, wherein the third section converges until an end of the row of burner heads; and allowing combustion of at least a portion of fuel in the mixed stream proximate one or more of the burner heads of the burner.

11. The method of claim 10, wherein allowing at least a portion of a fuel stream to flow to at least one inlet of a burner assembly comprises allowing the at least a portion of the fuel stream to flow directly to at least one inlet.

12. The method of claim 10, further comprising allowing at least a portion of the primary air stream and at least a portion of the fuel stream to mix by allowing flow through:

a fourth section comprising a fuel inlet, wherein the fourth section comprises a third converging portion;

a fifth section directly downstream of the fourth section and comprising a straight portion;

a sixth section directly downstream of the fifth section and comprising a second diverging portion;

a seventh section directly downstream of the sixth section and comprising a third diverging portion;

an eighth section directly downstream of the seventh section and comprising a fourth converging portion; and a ninth section directly downstream of the eighth section and comprising a fourth diverging portion.

13. The method of claim 10:

wherein allowing the flow through the second section comprises allowing the mixed stream to expand in the second section, and further comprising:

allowing at least a portion of the primary air stream and at least a portion of the fuel stream to mix by allowing flow through:

a fourth section comprising a fuel inlet, wherein the fourth section reduces the velocity of the mixed stream in the fourth section;

a fifth section;

a sixth section that allows the mixed stream to expand in the sixth section;

a seventh section that allows the mixed stream to expand in the seventh section;

an eighth section that reduces the velocity of the mixed stream in the eighth section; and a ninth section that allows the mixed stream to expand in the ninth section.

14. The method of claim 10, further comprising allowing at least a portion of a secondary air stream proximate one or more of the burner heads to at least partially mix with the mixed stream.

15. A burner assembly comprising:

a first end of a body;

at least two arms extending from the first end of the body, wherein each arm comprises a first end and a second opposing end;

at least two fuel inlets, wherein each fuel inlet is coupled proximate the first end of an arm;

a second end of the body opposing the first end, wherein the second end of each arm is coupled to the second end of the body, the second end comprising a row of burner heads;

at least two u-shaped curvature portions, wherein a u-shaped curvature portion of the at least two u-shaped portions is disposed between each fuel inlet and each second end of each arm;

at least two first sections of the body bordered on one side by the row of burner heads and having an opposite internal convex-shaped side, wherein each first section converges and is disposed proximate the second end of an arm, the first sections bordered on one side by the row of burner heads;

at least two second sections of the body bordered on one side by the row of burner heads and having an opposite internal convex and concave-shaped side, wherein each second section diverges and is disposed proximate a first section; and at least one third section of the body bordered on one side by the row of burner heads and having an opposite internal concave-shaped side portion, wherein each second section is disposed between at least one first section and at least one third section of the body, the third sections converging until reaching a substantially parallel portion of the third section of the body.

16. The burner assembly of claim 15, further comprising a fuel outlet adapted to deliver fuel to one or more of the fuel inlets.

17. The burner assembly of claim 15, wherein at least one of the first sections of the body comprises a first converging part.

18. The burner assembly of claim 15, wherein at least one of the third sections of the body comprises a second converging part.

19. The burner assembly of claim 15, wherein at least one of the fuel inlets comprises a second converging part.

20. The burner assembly of claim 15 wherein at least one of the arms comprises:

a fourth section comprising an approximately straight part; and a fifth section comprising a second diverging part.

* * * * *